United States Patent [19]

Dieperink et al.

[11] Patent Number: 4,640,113

[45] Date of Patent: Feb. 3, 1987

[54] SHEET-BENDING PRESS INCORPORATING A DEVICE FOR CONTINUOUS MONITORING OF THE BENDING ANGLE

[75] Inventors: Willem Dieperink, Buchillon, Switzerland; Arend Vruggink, Harfsen, Netherlands

[73] Assignee: Beyeler Machines, S.A., Crissier, Switzerland

[21] Appl. No.: 697,870

[22] Filed: Feb. 4, 1985

[30] Foreign Application Priority Data

Feb. 3, 1984 [CH] Switzerland ..... 504/84

[51] Int. Cl.[4] ..... B21D 5/00

[52] U.S. Cl. ..... 72/21; 72/26; 72/30; 72/389; 72/702

[58] Field of Search ..... 72/389, 21, 26, 30, 72/414, 307, 702, 7

[56] References Cited

U.S. PATENT DOCUMENTS

| | | | |
|---|---|---|---|
| 3,156,287 | 11/1964 | Munro | 72/702 |
| 3,990,291 | 11/1976 | Evertz et al. | 72/389 X |
| 4,408,471 | 10/1983 | Gossard et al. | 72/389 X |

FOREIGN PATENT DOCUMENTS

| | | | |
|---|---|---|---|
| 0585664 | 10/1959 | Canada | 72/389 |
| 2044199 | 3/1972 | Fed. Rep. of Germany | 72/389 |
| 0202928 | 12/1982 | Japan | 72/389 |
| 0959752 | 6/1964 | United Kingdom | 72/389 |

*Primary Examiner*—Lowell A. Larson
*Assistant Examiner*—Steve Katz
*Attorney, Agent, or Firm*—Cushman, Darby & Cushman

[57] ABSTRACT

A press has an upper table carrying a punch and a lower table bearing a tool-carrier. A jack for compensating the deflection inherent in the bending process is fitted in the lower table. The bending device enables the bending angle obtained in the workpiece to be monitored continuously. The bending device includes a series of paired measuring rods, circular in section and longitudinally machined to provide a flat surface for the lower surface of the workpiece to rest on, associated with devices for measuring the rotational angle of the measuring rods, and a control device connected to the rotational angle measuring device, to a device for controlling the jacks that actuate the punch and to the actuating device of the jack for compensating the deflection. A very accurate and constant bending angle is obtained throughout the length of the workpiece. The bending process is automatic and continuous once the operator has fed in the required bending angle.

12 Claims, 3 Drawing Figures

SHEET-BENDING PRESS INCORPORATING A DEVICE FOR CONTINUOUS MONITORING OF THE BENDING ANGLE

FIELD OF THE INVENTION

This invention relates to a press for bending sheet metal which incorporates, in the bending mechanism, means whereby the bending angle obtained in the workpiece may be continuously monitored.

When sheets of metal are bent by means of a press, there are two requirements that have to be met:

(1) the bending angle should be constant throughout the length of the workpiece, and (2) the bend obtained should be repeatable to the same degree of accuracy in each sheet.

BACKGROUND OF THE INVENTION

The bending angle obtained by conventional sheet-bending presses may present considerable variations along the line of the bend. This arises mainly from the following causes: deflection of the press itself during its working action, particularly in the upper and lower tables, in the uprights, and in the tooling; tool wear; and tolerances in the manufacture of the press, its tools, and in the quality and thickness of the material to be bent. Furthermore, when two apparently identical sheets of metal are bent, they do not have perfectly identical characteristics, so that the same punch movement may produce substantially different bends.

In the systems currently known and used, various means are used partially to overcome these problems; some of them employ compensating jacks to compensate deflection during the working of the press and to obtain a constant bending angle throughout the length of the workpiece. French Pat. No. 2,119,528, for example, describes a press comprising compensating jacks in the the lower table; European patent application published as No. 0,025,469 describes a press fitted with compensating jacks in the upper table, and French patent application No. 2,200,064 describes a press with compensating jacks in both the upper and lower tables. Unfortunately, presses of this type require many test bends and adjustments to obtain a satisfactory result, and with most of them the operator has to pre-determine the amount of deflection that can be expected from the press. Furthermore, they compensate only those differences of bending angle caused by deflection of the machine, its uprights and upper and lower tables, and not other differences, such as those caused by local deflection or wear in the die or the punch. Nor do they solve the problem of repeating the bend to the same degree of accuracy in successive sheets of metal. For from batch to batch, and even within a single batch, the sheets of metal are not always rigorously identical, varying in thickness, resistance, or elasticity. Even within a single sheet, the characteristics may very from point to point. Thus for the same punch movement the bending angles obtained in two different sheets of metal, or even in different places in the same sheet of metal, may present measurable differences. To overcome these drawbacks during the bending cycle, the bending angle needs to be monitored while it is being obtained.

There are presses which enable the bending angle to be measured during the bending process. Such presses are described for example in French and German patent applications Nos. 2,362,722 and 2,044,199 respectively, and U.S. patent specification No. 3,440,847. However, the measuring devices described in these specifications are not very accurate since they measure the bending angle outside the die: the weight of the workpiece causes a considerable margin of error. A more precise measurement of the bending angle is obtained by means of the device described in British patent application No. 2,072,551, which enables the angle to be measured at the point of bending, in the die. However, it does not give accurate readings of asymmetric bending, for example, such as when a sheet is bent close to one of its edges, as one side of the bend is then much heavier than the other.

A more accurate device for measuring the bending angle is described in German utility model 82-34-901.0, which relates to a small press for bending metal sections. In this device, the bending angle is determined at the bending point by means of two measuring rods each of which have a flat surface against which the section is pressed during the bending process, the rods being so placed that they rotate as the section is bent. Measuring rods of similar shape can advantageously be used in a device for monitoring the bending angle in presses for bending sheet metal.

SUMMARY OF THE INVENTION

The present invention aims to provide a sheet-bending press which permits the bending angle of sheet metal to be continuously and automatically monitored with the result that the required bending angle may be obtained automatically, with a high degree of accuracy, and with a constant bending angle throughout the length of the workpiece.

To achieve this, the present invention relates to a sheet-bending press as claimed in claim 1.

The invention also relates to a process for bending sheet metal by means of a press according to the invention, as claimed in claim 11.

DESCRIPTION OF THE DRAWINGS

The invention will be better understood from the description of a preferred embodiment that follows with reference to the drawings wherein.

DETAILED DESCRIPTION OF THE PREFERRED EMBODIMENT

Figure 1:
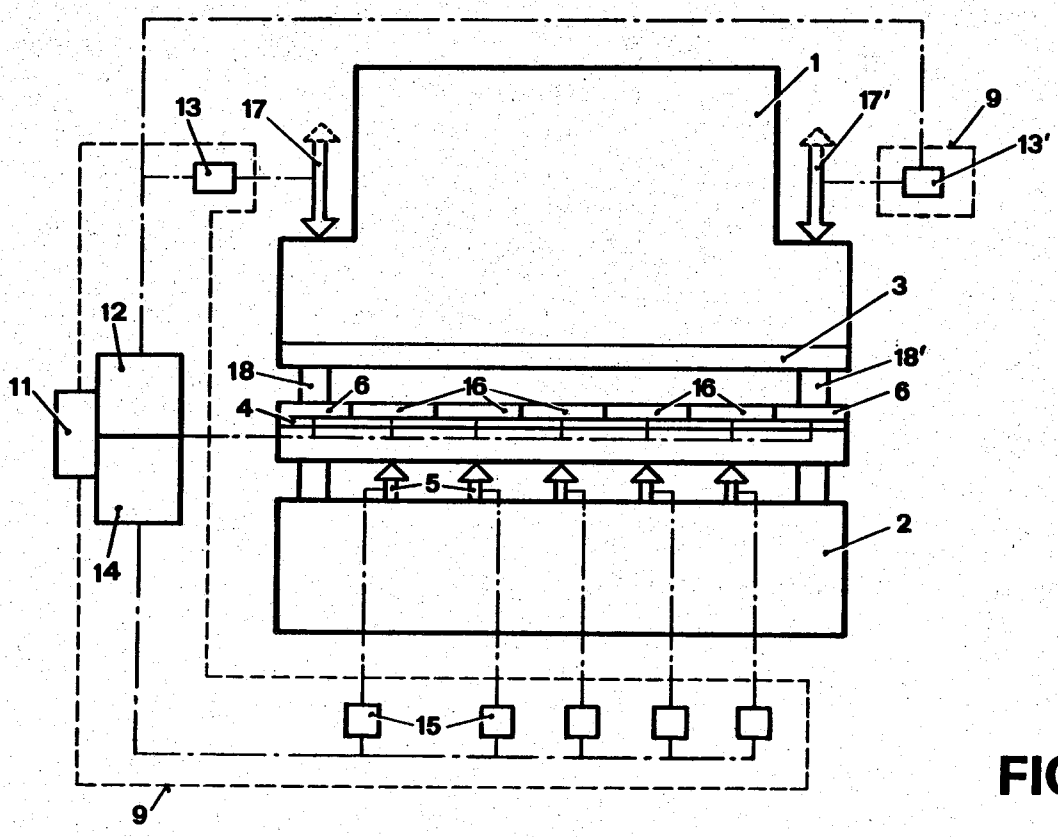
FIG. 1 represents a diagrammatic longitudinal section of an example of a press according to the invention.
Figure 2:
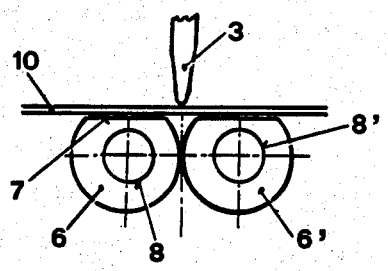
FIG. 2 represents an embodiment of a pair of measuring rods, before bending takes place, seen in partial cross section.
Figure 3:
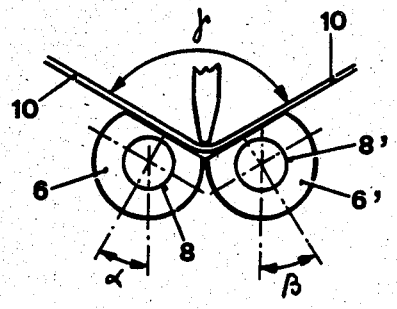
FIG. 3 represents an example of a pair of measuring rods, during the bending process, in partial cross section.

The press comprises an upper table 1 and a lower table 2. The upper table carries a punch 3 and the lower table a tool-carrier 4. The upper table is equipped with two jacks 17 and 17' which actuate the punch 3. A means 5 for compensating deflection is situated in a window in the lower table. It serves to remedy the defects inherent in the bending process, such as deflection in the press while bending takes place, variations in the quality of the sheet metal, etc. The device for monitoring the bending angle of the sheet comprises two pairs of measuring rods 6 and 6' and a plurality of pairs of measuring rods 16 and 16', each of these rods 6, 6', 16, and 16' being circular in section and longitudinally machined to provide a flat upper surface 7, each pair of rods being housed in spaced parallel relation in the upper surface of the tool-carrier 4, each of the two pairs of rods 6 and 6' being situated above an upright 18 and 18' of the press, the pairs of rods 16 and 16' being situated above the compensating means 5, there being one pair of rods 16 and 16' to each compensating means. Adjacent pairs of measuring rods are placed end-to-end so that their flat surfaces 7 constitute two continuous surfaces.

Integral with each measuring rod is a measuring device 8 which serves to measure the angle of rotation of the rod. In the embodiment shown by way of example in the drawings, each measuring device 8 is constituted by two potentiometers, one in each of the two rods 6 and 6', or 16 and 16'. The device further comprises a control device 9 connected to the various measuring means 8, to a means 13 and 13' for controlling the jacks 17 and 17' which cause the movement of the punch 3, as well as to a means 15 for controlling the compensating means 5.

The bending angle of the workpiece 10 is monitored as follows: at the start of the bending process, the workpiece is placed so that its lower surface is in contact with the flat surfaces 7 of the measuring rods. The value of the required bending angle is fed into control box 11 and thereafter the whole bending process takes place automatically, without pause and without need for the operator to intervene. During the bending operation, when the sheet metal 10 begins to bend under the pressure of the punch 3, the machined flat surfaces 7 of the measuring rods remain in contact with the workpiece, thus causing the measuring rods to rotate. This rotation is measured by the measuring means 8; rotational angles $\alpha$ and $\beta$, measured absolutely for each rod of each pair of rods 6 and 6' or 16 and 16', are added together by the control device 9 to determine the instantaneous bending angle $\gamma$ at every point along the bend in the workpiece. The control device 9 is programmed to compare the various instantaneous punctual values of the bending angle and to initiate the action of one or several compensating means 5, so as to obtain a uniform bending angle along the whole length of the workpiece. It also controls the movement of the punch 3 through the control means 13 and 13' of the main jacks 17 and 17', so that the bending operation is performed without pause, the same process being repeated continuously and automatically until the required bending angle is obtained along the whole length of the workpiece. The control device may cause different pressures to be exerted by jacks 17 and 17' respectively.

In a preferred embodiment of the press, the punctual values measured along the workpiece are compared with each other by electronic means 14, while electronic means 12 compares these values with the set bending angle, the means 13 and 13' for controlling jacks 17 and 17' being constituted by servo-valves, and the control means 15 for the compensating means 5 being constituted by pressure valves or servo-valves, in numbers equal to the number of the compensating means 5.

In conventional sheet-bending presses, the stroke of the punch has to be set to a predetermined value before the bending cycle starts. In the press according to the invention, the depth of stroke is continuously monitored by control device 9 until the required bending angle is obtained. The result is a very accurate bending angle of a constant value throughout the length of the workpiece. Furthermore, the bending process no longer requires any intervention on the part of the operator: it is performed without any apparent interruption in the bending movement, thus saving an appreciable amount of time.

Furthermore, the problem of the bending angle opening slightly after the operation of the press, due to the elasticity of the sheet metal, is easily solved by the present press. The control device 9 can be programmed so that, when the required bending angle is obtained, this device automatically reduces the pressure exerted by the punch. If variation in the bending angle is detected (owing to flexing of the workpiece), the bending operation is repeated to a smaller angle than the preset value, taking the predictable flexing of the sheet into account. This process is repeated automatically until the preset value is finally obtained.

In the press described above, the measuring rods are built into the surface of the tool-carrier. In another embodiment of the press, the measuring rods are built into the lower table or bed of the press, there being no tool-carrier 4. In this embodiment they are integral with the lower table. In yet another embodiment, the functions of the upper and lower tables are reversed and the measuring rods are therefore placed either in the upper table or in the surface of a tool-carrier affixed to the upper table, the punch being integral with the lower table.

In the principal embodiment described above, the compensating means 5 is placed within the lower table or bed. It may of course be situated in the upper table, or in both upper and lower tables. In particular, this compensating means may be placed within a window in either table. In another, interesting embodiment, the lower table comprises two parts, the first being constituted by a carrier table bearing the compensating means 5, the said means bearing one or several flexible tables in the surface of which are embedded the pairs of measuring rods.

In the embodiment represented in the drawings, the bending device is fitted with five compensating means 5 and above them are five pairs of measuring rods 16 and 16'. Depending on the length of the press and the required degree of accuracy of bending angle, a greater or lesser number of compensating means 5 and pairs of measuring rods 16 and 16' will be chosen. The uprights of the press, opposite which are situated the pair of measuring rods 6 and 6' respectively, play the role of "fixed pistons".

All the bending operations of the press, comprising in particular the work performed by the control device 9 in actuating the compensating means 5 and the devices controlling the movements of the punch 3, are carried out automatically until the precise required bending angle is obtained.

Compared with known presses, the press according to the invention presents numerous advantages. The combination of compensating means 5 with pairs of measuring rods linked to a control device 9 eliminates all the variations in bending angle caused, in a single sheet of metal, by any one of the deflections mentioned above—in the machine, the uprights, the upper or lower tables, the die, or the punch—or by thickness tolerances in the workpiece, or caused, in a series of bending operations on a batch or batches of sheets, by differences in thickness, resistance, or elasticity of the workpieces. Furthermore, presses according to the invention overcome the problems involved in asymmetrical bending and those arising from non-parallel movements of the punch. In the latter case, the bending angle obtained will be constant along the whole length of the workpiece, even with narrow sheets, as long as they are placed so that they remain in contact with at least two pairs of measuring rods.

What is claimed is:

1. A press for bending sheet metal comprising an upper table and a lower table, one of which carries a punch, further comprising two means for actuating the movement of the punch and mounted on the punch, at least one means for compensating the deflection inherent in bending operations and mounted in one of the tables, and a bending device that continuously monitors the bending process and comprising:

(a) two pairs of measuring rods situated opposite the uprights of the press and at least one pair of measuring rods situated opposite the compensating means, the measuring rods being circular in section and longitudinally machined with a flat upper surface provided for supporting the workpiece, each of the measuring rods being seated in such a manner that it rotates with the bending of the workpiece, each pair of measuring rods being connected to a device for measuring the rotational angle of the measuring rods, (b) a control device connected to the measuring devices, to the means actuating the movement of the punch, and to the compensating means, comprising:

a first means whereby the data provided by the measuring means is compared with a preset value;

a second means (13, 13') for controlling the means actuating the movement of the punch;

a third means for comparing the data provided by the various measuring devices, and for causing a fourth means (15) to control the compensating means so that a constant bending angle is obtained along the whole length of the workpiece.

2. A press as claimed in claim 1 further comprising a plurality of compensating means, placed at intervals along the length of the press, wherein the bending device comprises a plurality of pairs of measuring rods respectively connected to a plurality of measuring devices, the number of pairs of measuring rods being equal to the number of compensating means, wherein the second means (13, 13') permits individual control of the means actuating the movement of the punch, and wherein the control device causes the fourth means (15) to take account of the interaction of the compensating means while controlling the operation of said compensating means.

3. A press as claimed in claim 2 wherein the measuring devices are so placed as to measure the absolute rotation of each of the measuring rods, the rotational values obtained from each pair of rods being then added together by the control device to determine the instantaneous bending angle at every point in the workpiece.

4. A press as claimed in claim 3, in which one of the tables carries a punch, wherein the measuring rods are housed in the other table.

5. A press as claimed in claim 3, in which one of the tables carries a punch, wherein the other table bears a tool-carrier and wherein the measuring rods are housed in the said tool-carrier.

6. A press as claimed in any one of the preceding claims wherein at least one of the tables comprises a window in which are fitted the compensating means.

7. A press as claimed in one of claims 1 through 5 wherein the compensating means is situated within a window in the lower table and wherein the said compensating means is so placed as to apply pressure against the upper face of the window while bearing on at least two lateral plates situated in parallel relation to the lower table.

8. A press as claimed in one of claims 1 through 5 wherein the lower table comprises a first part constituted by at least one carrier table and a second part constituted by at least one flexible table supported by the compensating means and carrying the bending device.

9. A press as claimed in claim 7 wherein at least one compensating means is situated within a window in the upper table.

10. A press as claimed in claim 8 wherein at least one compensating means is situated within a window in the upper table.

11. A new and automatic process for bending sheet metal by means of a press comprising an upper table and a lower table, two means for actuating the movement of a punch carried by one of the said tables, said actuating means being mounted on the punch, and at least one means for compensating the deflection inherent in bending operations and mounted in one of the tables, characterized by comprising the steps of:

continuously measuring the bending angle of the workpiece at a plurality of points spaced throughout the length of the workpiece by means of two pairs of measuring rods situated opposite the uprights of the press and at least one pair of measuring rods situated opposite the compensating means, the measuring rods being circular in section and longitudinally machined to provide a flat upper surface against which is placed one of the surfaces of the workpiece, each of the measuring rods being seated in such a manner that it turns with the bending of the workpiece, each pair of measuring rods being connected to a device for measuring the rotational angle of the measuring rods, comparing the angles measured by means of a first electronic means, acting punctually on the workpiece by means of the compensating means, the said compensating means, being actuated by control means linked to the said electronic means, so as to obtain a constant bending angle throughout the length of the workpiece, comparing the bending angle obtained with the required bending angle by means of a second electronic means, continuing the bending by actuating the means actuating the movement of the punch, the said actuating means being controlled by a control means linked to the said electronic means, repeating the process until the required bending angle is obtained.

12. A process as claimed in claim 11 further comprising the steps of reducing the pressure on the punch when the required bending angle is obtained, continuing the measuring process in order to ascertain whether there is variation in the bending angle due to flexing of the workpiece, and repeating the bending process after modifying the required bending angle to take account of the predictable flexing of the workpiece, the process being repeated until the required bending angle is obtained after the workpiece has ceased to flex.

* * * * *